US008388835B2

(12) United States Patent
Haschke

(10) Patent No.: US 8,388,835 B2
(45) Date of Patent: Mar. 5, 2013

(54) REMOVABLY ENGAGEABLE STORM DRAIN INLET SCREEN

(76) Inventor: Dieter Haschke, San Diego, CA (US)

( * ) Notice: Subject to any disclaimer, the term of this patent is extended or adjusted under 35 U.S.C. 154(b) by 213 days.

(21) Appl. No.: 12/759,624

(22) Filed: Apr. 13, 2010

(65) Prior Publication Data

US 2010/0258490 A1 Oct. 14, 2010

(51) Int. Cl.
*E03F 5/06* (2006.01)

(52) U.S. Cl. ..... 210/162; 210/463; 210/170.03; 210/474; 404/4

(58) Field of Classification Search ..... 210/162, 210/163, 164, 170.03, 474; 404/2, 4, 5
See application file for complete search history.

(56) References Cited

U.S. PATENT DOCUMENTS

| | | | | |
|---|---|---|---|---|
| 5,405,539 | A * | 4/1995 | Schneider | 210/163 |
| 5,733,445 | A * | 3/1998 | Fanelli | 210/164 |
| 6,214,216 | B1 * | 4/2001 | Isaacson | 210/162 |
| 6,254,770 | B1 * | 7/2001 | Remon | 210/163 |
| 6,368,499 | B1 * | 4/2002 | Sharpless | 210/164 |
| 6,811,708 | B2 * | 11/2004 | Shaw et al. | 210/163 |
| 6,945,733 | B2 * | 9/2005 | Rathmann et al. | 210/163 |
| 6,994,783 | B2 * | 2/2006 | Use et al. | 210/162 |
| 7,300,574 | B1 * | 11/2007 | Lewis | 210/163 |
| 7,357,861 | B2 * | 4/2008 | Kelley et al. | 210/162 |
| 7,922,916 | B1 * | 4/2011 | Witt | 210/170.03 |
| 2003/0047497 | A1 * | 3/2003 | Harris et al. | 210/163 |
| 2006/0159515 | A1 * | 7/2006 | Messerschimidt et al. | 404/4 |

* cited by examiner

*Primary Examiner* — Christopher Upton
(74) *Attorney, Agent, or Firm* — Donn K. Harms

(57) ABSTRACT

A storm drain inlet filter for preventing passage of particulate and solids in storm water entering a storm drainage system through an entry aperture. The device features a filter element held in place by a ring compressed against the sidewalls forming the entry aperture. Filter fabric may be included between two sidewalls of the inlet filter.

11 Claims, 2 Drawing Sheets

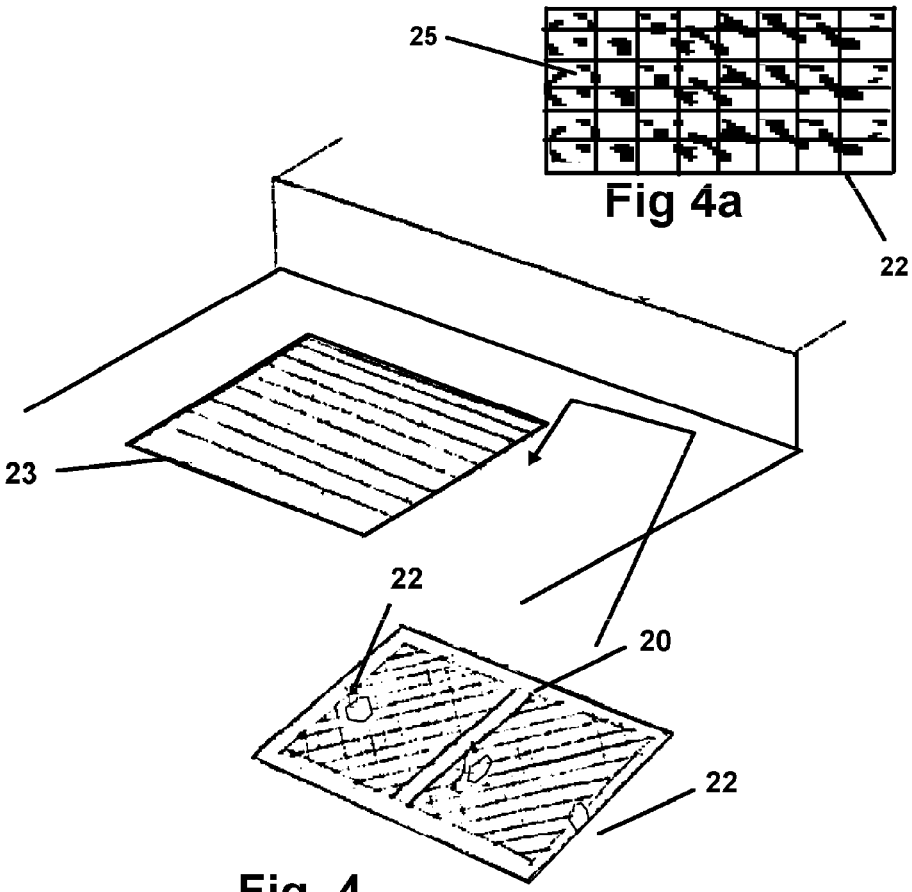
Fig 4a
Fig. 4
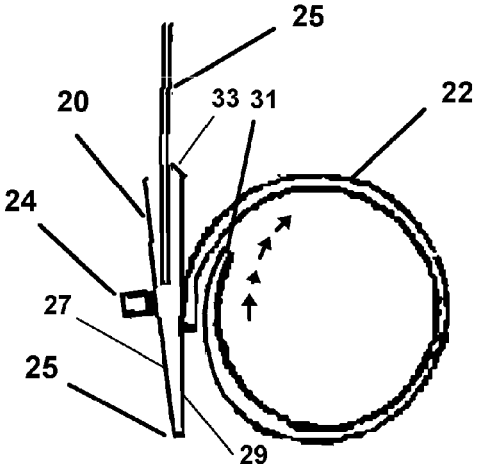
Fig. 6
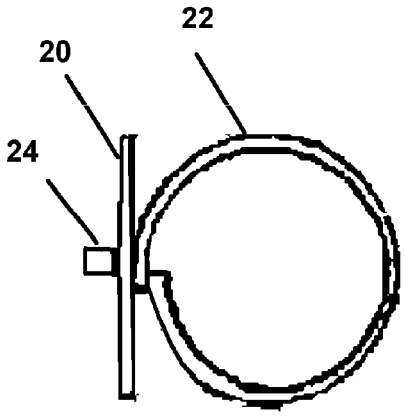
Fig. 5

REMOVABLY ENGAGEABLE STORM DRAIN INLET SCREEN

This application claims priority to U.S. Provisional Application No. 61/168736, filed on Apr. 13, 2009 and is incorporated herein in its entirety by reference.

BACKGROUND OF THE INVENTION

1. Field of the Invention

The invention herein disclosed relates generally to a curb inlet filter for storm drains. More particularly, to a curb inlet filter for filtering out debris and sediments and the like which is adapted to removably engage with such an inlet and prevent debris, soil, trash, and sediment from entering the storm drainage system where it can easily contaminate the shoreline.

2. Prior Art

Runoff, in the form of water from heavy rains or melted snow, in order to maintain streets in a driveable condition and to prevent flooding locally, is conventionally collected in a storm sewer system. Such systems generally collect runoff through grates in the street surface or through curb inlets which provide an aperture for runoff to flow into the storm drain sewer system.

In most municipalities in the United States and worldwide, the runoff water collected in the storm drain system has not been viewed as particularly hazardous to the health of humans and animals. Consequently, most storm drainage systems collect runoff and channel it directly into the ocean or a river. However, in recent years, it has been found that such runoff carries particulate and trash and other solids and dissolved solids along with it and into the body of water into which it exits. The result being that the nations's seashores, harbors and rivers have become polluted with trash, soil, particulate, leaves, bacteria and just about anything that might be carried by runoff water into the drains and the underlying storm sewer systems which collect this runoff.

Plastics are of special concern in that they easily float in the ocean or a stream and they are long lived since they are unaffected by weather and do not dissolve in water. Over time they collect on seashores and on the shores around other bodies of water that receive storm runoff. These plastics such as six-pack can restraints can be particularly hazardous to wildlife encountering them.

Another concern in recent years is that of silt and soil particulate which is collected by runoff water and deposited into storm drains suspended in the runoff water. Such material upon reaching the ocean, a lake or shallow bay, over time, settles to the bottom thereby raising the bottom of harbors, lake beds and river beds. Over time this can become hazardous to shipping traffic as well as personal water craft. Further, the storm drain system itself can become clogged or can be rendered inoperable if too much soil and silt enters the system during a large runoff period. Silt is especially a problem during the building of large homes and commercial building tracts. During the building process, with heavy grading, the soil becomes denuded and is easily washed away by runoff into the storm sewer system.

In the past, numerous products have been employed in attempts to prevent sediment, trash, and other solids from flowing into curb inlets during runoff periods where they are communicated to the storm sewer system. Products such as straw wattles have been used to filter out sediment and other solids flowing into a curb inlet storm drain by placing them in front of such inlets. Hay bails have also been used to filter out sediment and other solids from the runoff flowing into a curb inlet. Other attempts have used permanent grates, stones wrapped in chicken wire and fabric filters covering grates.

The straw wattle and hay bail type of sediment filters often get clogged and are rendered useless. Additionally, as they are made of organic material, they may decompose and slip into the storm drain system only to cause the clogging they are trying to prevent. Further, neither the straw, hay, or stone bundles wrapped in wire, filter out silt and fine soils which have particles small enough to move through them.

Metal filters and screens have also been tried without great success. Such filter systems generally are placed in a temporary fashion with weights or belts to hold them and are easily dislodged, stolen or removed by vandals who can see that they are only placed with weights or belts. Other metal and metallic screen filters are permanent in nature and as such are harder to install and remove which can be a major problem if they clog since they can cause flooding if not removed quickly.

As such, their exists an unmet need for a storm drain inlet filter that is easy to engage and disengage to filter incoming runoff to a storm drain inlet and remains engaged during high water flow. Such a device in order to dissuade vandals and theft should have the appearance of being permanently installed, yet should be easily removable and engageable to storm drain inlets of varying sizes to thereby filter such inlets. Such a device, once engaged, should serve to keep soil, sediment, silt, trash and solids, out of the storm water system. However, in keeping such materials out of the storm water system, such a device should also not require cleaning constantly which increases cost. Instead, it should be adapted to deflect such solid materials in the runoff, back into the street where street sweepers may later remove it. Finally, such a device, should be easily and securely engageable to a large variety of different sized storm drain inlets due to the wide variance in standard sizing of such and should do so without modification for each different size.

SUMMARY OF THE INVENTION

The disclosed device provides a remedy to the noted shortcomings of conventional storm drain inlet filtering devices and systems. The disclosed device is formed of corrosion resistant and sturdy metal components such as aluminum or galvanized steel or stainless steel, which will last many years in the harsh environment of storm drain filtration.

The device is adapted to an easy fitment to filter the incoming runoff from virtually any sized storm drain inlet aperture, most of which vary in height by a number of inches. The engagement means employs a novel compression initiated and subsequently biased engagement, of a plurality expandable pressure clips or hoops, within the aperture, depending on their individual construction.

The employment of compressible metal rings or hoops as a means for removable engagement for the engaged filtering screen provides a sturdy operative positioning of the filtering screen in front of a storm drain inlet to prevent entry of debris. Because the compressible rings are hidden, yet provide substantial outward pressure to the sides of the aperture, they provide a sturdy yet indiscernible mount of the filtering screen in position in front of the aperture and mounting rings. With the filtering screen abutting the curb and covering the aperture the device appears permanently engaged in a filtering position. This provides a means to discourage vandalism and theft since visually it appears permanently in place. However, the device is actually easily engaged and disengaged by imparting sufficient force on the device to overcome the biased engagement of the hoops or rings to the sidewalls surrounding the drain aperture inlet to the storm drain system.

The device features an inlet screen filter sized to cover the aperture inlet and overlap the surrounding curb and abut the street surface. The inlet screen filter is welded or otherwise engaged to the compressible rings such that the screen filter will be operatively engaged to cover substantially all of a storm drain inlet aperture and thereby provide a means to prevent solids and particulate from entering the storm system. The inlet screen may be simply a fine wire mesh with small apertures between the mesh strands. The mesh apertures would be small enough to stop most particulate and plastics. Or alternatively, the inlet screen may function to house a fabric mesh or fine metal mesh type of screen filter. Such fabric mesh is either woven or otherwise formed to form a thickness of material through which liquid must take a serpentine path through strands of material, from one side to the other. Fine particulate become trapped between the fibers forming the serpentine path and the fabric mesh thereby prevents silt and very small particles from entering the system.

When employed to operatively house filter fabrics or fine mesh filters, the inlet screen may have a pair of sidewalls to hold the filter element in a sandwiched engagement and may employ a hinged or cooperative engagement of the two sidewalls formed of mesh to serve to hold the filtering fabric or screen therebetween. Using this preferred configuration, the filtering fabric or screen element may periodically be replaced if it becomes clogged since it may easily be dismounted from the device by removing it from between the two sidewalls holding it in place.

The perimeter of the inlet screen would be at least the same size as the perimeter of the inlet aperture to the storm drain, to thereby operatively engage therein. This mode of the device places the inlet screen recessed from the edge of the curb and out of the way from harm from cars or other hazards.

The perimeter of the inlet screen may also be slightly oversized to allow an engagement over the perimeter edge of the inlet aperture generally formed by the surface of the curb. In all modes of the device, a horizontal reinforcement member is preferred to provide support. The reinforcement member is operatively engaged to a side surface of the inlet screen preferably the surface opposite that to which the mounting rings are attached. The reinforcement member is positioned to run axially in the same direction as the long axis of the drain inlet aperture formed in the curb.

If the inlet screen is sized to engage within the perimeter of the drain aperture, in a recessed engagement, the horizontal member may be slightly longer than the length of the aperture and have a pair of overhanging portions. These overhanging portions serve to contact the curb sidewall surface and provide a means to prevent the device from falling into the drain basin through the aperture. If the inlet screen has a perimeter that is slightly larger than the inlet interior aperture, the horizontal member, if employed, may be the same size as the screen and simply provides a means to provide rigidity to the attached screen.

For debris entry prevention, when in the engaged position with horizontally disposed drain inlet apertures, such as can be found on the walking surface of a sidewalk, or driving surface of the road, the device may employ the same compression ring or hooped engagement for the overlying screen filter element. In this mode, the hoop or ring fasteners will fit through the gaps of the rungs of a horizontal drain cover and hold the overlying filter screen element adjacent to the drain inlet with a biasing force from the rings. The same metal mesh or combination of metal mesh and internally housed filter fabric may be employed to prevent entry of silt, particulate, trash, plastics, and other materials carried by runoff, into the drainage system.

Still further, the device in either mode may be formed from a tough nonmetallic synthetic material such as polypropylene or recycled plastics, fiberglass or carbon fiber. However, due to the severe operating environment in which the device must perform, the current preferred mode employs galvanized or stainless steel to provide a strong and long lasting device in the harsh operating environment of storm drains and roads.

With respect to the above description, before explaining at least one preferred embodiment of the storm drain inlet screen herein, in detail, it is to be understood that the invention is not limited in its application to the details of operation nor the arrangement of the components or steps set forth in the following description or illustrations in the drawings. The various methods of implementation and operation of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of compression ring engaged storm drain inlet filtering devices. It is important, therefore, that the objects and claims be regarded as including such equivalent construction and methodology insofar as they do not depart from the spirit and scope of the present invention.

It is an object of this invention to provide an easily engaged and disengaged storm drain inlet filter which will encourage widespread use and deployment.

It is another object of this invention to provide such a storm drain inlet filter which once engaged upon a storm drain inlet will reject trash and particulate and such from entry into the storm drains but will concurrently leave such in the street where it may later be swept.

Yet another object of the device is to provide a storm drain inlet filter which from all appearances is permanently installed to discourage theft and vandalism.

Still further, it is an object of the disclosed invention to provide such an easily deployable storm drain inlet which once widely employed, will help eliminate trash and the like from the shores of water bodies into which drains deposit runoff.

These together with other objects and advantages which become subsequently apparent, reside in the details of the construction and operation of the disclosed storm drain inlet filter as more fully hereinafter described and claimed, reference being had to the accompanying drawings forming a part thereof, wherein like numerals refer to like parts throughout.

BRIEF DESCRIPTION OF DRAWING FIGURES

FIG. 4 shows a mode of the device using the same compressible rings and adapted for engagement over a planar grate style drain inlet using the expandable rings on one side to hold it in place with the grate.

FIG. 4*a* depicts the filter screen having filter fabric or sandwiched between sidewalls.

FIG. 5 depicts an end view of the device using the compressible mounting ring and showing the engaged inlet screen and horizontal member.

FIG. 6 shows a mode of the device of FIG. 5 wherein the inlet screen functions to operatively engage water filter fabric or fine metal mesh like steel wool which is sandwiched between two screen sidewalls and employed to reject silt and fine particulate from entry into the drain system.

DETAILED DESCRIPTION OF THE PREFERRED EMBODIMENTS OF THE INVENTION

Figure 1:
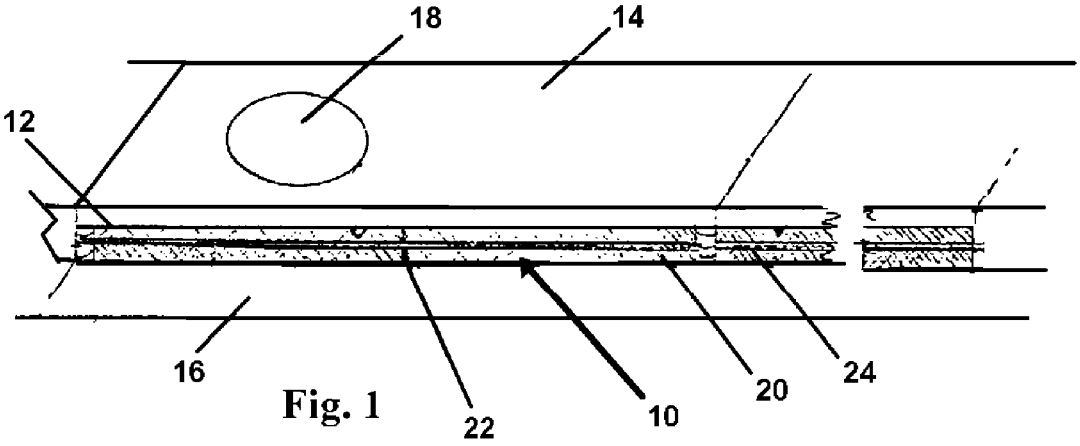
FIG. 1 depicts the device in an as-used position covering a typical storm drain inlet as positioned adjacent to a roadway on the road facing side of a curb.

Referring now to the drawings in FIGS. 1-6, wherein similar components are identified by like reference numerals, there is seen in FIG. 1, the disclosed device 10 in an as-used position operatively engaged with an elongated horizontally disposed inlet aperture 12. Such inlet apertures 12 are typically provided as an entrance to the underlaying drain system as are typically employed where curbs and sidewalks 14 are positioned parallel to roads 16.

Figure 2:
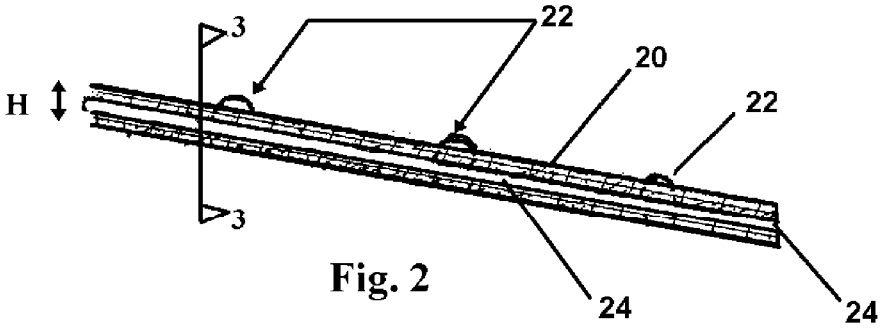
FIG. 2 shows a frontal view of the filter screen with mounting rings engaged to the rear and adapted to engage with the sidewalls of a storm drain in a biased engagement.
Figure 3:
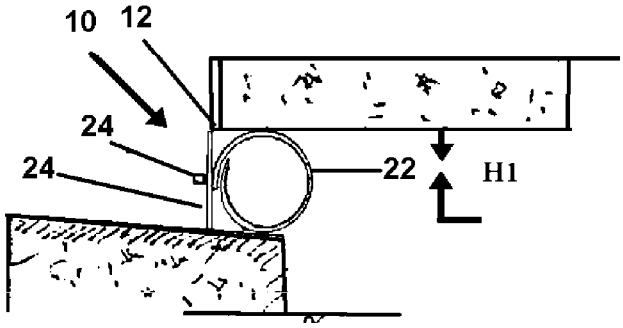
FIG. 3 is a sectional view through the engaged device of FIG. 1 showing the device in a biased engagement with a drain inlet aperture.

Conventionally, such inlet apertures 12 communicate to catch basins which catch larger debris before it can enter underlying drains and is later removed through a manhole 18 access. As shown in FIGS. 1-3 and more particularly in FIGS. 5-6, the filter screen 20, is engaged structurally to be vertically supported by compressible rings 22 projecting from an engagement from a second side surface of the filter screen 20.

The height of the filter screen 20 is adapted to substantially cover all of the passage defined by the sidewalls of the sidewalk, curb, and street, forming the inlet aperture 12 when in the as-used position of FIG. 1. A horizontal member 24 such as a steel tube, is preferred to provide support to maintain the filter screen 20 planar and vertically disposed substantially perpendicular to the roadway and in position to prevent debris from entering the aperture 12. When the filter screen 20 is sized for a recessed engagement within the inlet aperture 12, the horizontal member 24 has a length slightly longer than that of the filter screen 20. This engagement provides member extensions which provide a means to prevent the device 10 from slipping through the inlet aperture 12 if the perimeter edge of the filter screen 20 is sized for a recessed engagement within the inlet aperture 12.

Engagement of the device to the as-used position with an inlet aperture 12, as shown in FIG. 1, employs the novel system of attached compressible rings 22 which extend from the second side surface of the filter screen 20 adjacent to the inlet aperture 12. As shown in FIG. 2, the height "H" of the compressible rings 22 is such that when pushed within the drain aperture 12, they are collapsed to a compressed height "H1". In this compressed height, the rings 22 naturally attempt to expand and will thereby provide a means for biased engagement with the side surfaces forming the perimeter of the inlet aperture 12.

In FIG. 4 is shown another mode of the device 10 wherein the filter screen 20 portion is adapted for a horizontal deployment over a grate style inlet aperture. The rings 22 or similar compressible fasteners are pushed through the spaces in the grate 23 to thereby hold the device 10 in an as-used position.

The compressible ring 22 may be formed of a circular metal or plastic body of a fixed circumference as shown in FIG. 5. In FIG. 5 there is shown a sectional view of the device 10 through FIG. 1 or FIG. 3 showing the compressible ring 22 which is slightly flattened when engaged in the inlet aperture 12. Attached is the filter screen 20 and horizontal member 24. The filter screen 20 may in this mode be a mesh formed of metal having gaps sized to prevent particulate from entering the storm drains. Or, the filter screen 20 of FIG. 6 might be employed to provide the extra filtering of a layer of filter fabric 25.

In FIG. 6 is depicted a sliced view of another mode of the device 10 wherein the ring features a translatable distal end 31 which will slide in a circular fashion when the ring is compressed within the inlet aperture. This mode of the device 10 may provide a slightly easier-to-install device 10 in that the ring 22 will change circumference and more easily compress than the fixed circumference ring 22. The translatable mode of the ring 22 may be employed in locales where less outward biasing force is required to hold the device 10 in place in the as-used position with a drain.

Also depicted in FIG. 6 is a mode of the filter screen 20 adapted to house filter fabric 25 formed of textile or metal having a serpentine path through fibers or having a finer mesh with smaller passages than that of the filter screen 20. The filter fabric 25 will engage in a sandwiched position between two sidewalls 27 and 29 forming the filter screen 20 to position it in the flow of the runoff during use to catch smaller particulate. A hinged end 25 can be formed of a flexible metal connection or a hinge to provide a means to open the two sidewalls 27 and 29 of the filter screen 20. A clip 33 or other engagement may be employed to hold the two sidewalls 27 and 29 in the sandwiched engagement with the filter fabric 25.

While all of the fundamental characteristics and features of the storm drain inlet screen device been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A storm drain inlet filter apparatus for preventing passage of particulate and solids in water entering through an entry aperture defined by an aperture perimeter and communicating with an underlying storm drain system, comprising:

a filter element, said filter element having a perimeter, said perimeter defining an area of a first side surface and an opposing second side surface;

a mount, said mount projecting from said first side surface;

means for biased engagement of said mount with sidewalls defining said entry aperture to thereby position said filter element in an as used position comprising, said mount comprising a ring having a diameter, said diameter of said ring being larger than a diameter of said entry aperture which said ring contacts in said biased engagement, said filter element positionable to said as-used position by a forcing of said ring within said aperture whereby a deformation of said ring imparts an outward force on said ring, and said outward force providing said biased engaged of said ring; and said filter element in said as-used position, providing a filtering of substantially all said water prior to said water entering said entry aperture.

2. The storm drain inlet filter of claim 1 additionally comprising:

said perimeter of said filter element being sized larger than said aperture perimeter thereby creating an overhanging portion of said filter element; and said overhanging portion contacting a surface surrounding said entry aperture when said filter element is in said as-used position.

3. The storm drain inlet filter of claim 2 additionally comprising:

a gap between said first side surface and said second side surface of said filter element;

filter fabric located in said gap, said filter fabric formed of fibers defining a serpentine path therethrough; and said serpentine path providing a secondary means to filter solids from said water.

4. The storm drain inlet filter of claim 3 additionally comprising:

said filter fabric replaceable through an opening in a side edge of said filter element.

5. The storm drain inlet filter of claim 2 additionally comprising:

said ring having a first end engaged to said first side surface of said filter element;

said ring formed of a generally circular shaped member;

said ring having a distal end;

said distal end translatable relative to said first end; and whereby said diameter of said ring is reduced when in said biased engagement with said sidewalls.

6. The storm drain inlet filter of claim 1 additionally comprising:

said perimeter of said filter element being sized slightly smaller than said aperture perimeter; and said filter element being recessed within said entry aperture when said filter element is in said as-used position.

7. The storm drain inlet filter of claim 6 additionally comprising:

a gap between said first side surface and said second side surface of said filter element;

filter fabric located in said gap, said filter fabric formed of fibers defining a serpentine path therethrough; and said serpentine path providing a secondary means to filter solids from said water.

8. The storm drain inlet filter of claim 7 additionally comprising:

said filter fabric replaceable through an opening in a side edge of said filter element.

9. The storm drain inlet filter of claim 1 additionally comprising:

a gap between said first side surface and said second side surface of said filter element;

filter fabric located in said gap, said filter fabric formed of fibers defining a serpentine path therethrough; and said serpentine path providing a secondary means to filter solids from said water.

10. The storm drain inlet filter of claim 9 additionally comprising:

said filter fabric replaceable through an opening in a side edge of said filter element.

11. The storm drain inlet filter of claim 1 additionally comprising:

said ring having a first end engaged to said first side surface of said filter element;

said ring formed of a generally circular shaped member;

said ring having a distal end;

said distal end translatable relative to said first end; and whereby said diameter of said ring is reduced when in said biased engagement with said sidewalls.

* * * * *